United States Patent [19]

Toda et al.

[11] 4,352,873

[45] Oct. 5, 1982

[54] SILVER HALIDE COLOR PHOTOGRAPHIC MATERIALS

[75] Inventors: Yuzo Toda; Junji Koizumi; Masasi Ogawa; Hidefumi Sera; Seiiti Kubodera, all of Minami-ashigara, Japan

[73] Assignee: Fuji Photo Film Co., Ltd., Kanagawa, Japan

[21] Appl. No.: 258,216

[22] Filed: Apr. 27, 1981

[30] Foreign Application Priority Data

Apr. 25, 1980 [JP] Japan ..... 55-55085

[51] Int. Cl.[3] ..... G03C 1/40; G03C 1/72

[52] U.S. Cl. ..... 430/545; 430/551; 430/556; 430/557; 430/558; 430/629

[58] Field of Search ..... 430/545, 551, 556, 557, 430/558, 629, 621

[56] References Cited

U.S. PATENT DOCUMENTS

| | | | |
|---|---|---|---|
| 3,748,143 | 7/1973 | Bowman | 430/629 |
| 3,827,890 | 8/1974 | Saleck et al. | 430/629 |
| 4,291,113 | 9/1981 | Minamizono et al. | 430/546 |
| 4,294,921 | 10/1981 | Yamaguchi et al. | 430/621 |

*Primary Examiner*—J. Travis Brown

*Attorney, Agent, or Firm*—Sughrue, Mion, Zinn, Macpeak & Seas

[57] ABSTRACT

A silver halide color photographic material comprising: a support; and a plurality of photographic layers including silver halide emulsion layer formed thereon, wherein one of said photographic layers is comprised of a compound containing recurring unit represented by formula (I)

wherein R represents a hydrogen, an alkyl group having 1 to 6 carbon atoms, or a halogen group; M represents hydrogen, an alkali metal, an alkaline earth metal, or an organic base; X represents an alkyl group having 1 to 6 carbon atoms, an alkoxy group, an alkylamino group or a halogen group; m represents 0, 1, or 2 and n represents 1 or 2.

9 Claims, No Drawings

SILVER HALIDE COLOR PHOTOGRAPHIC MATERIALS

FIELD OF THE INVENTION

This invention relates to silver halide color photographic materials (hereinafter, are referred to as color photographic materials), and in particular to a compound used in connection with color photographic materials which restricts the formation of strains during development.

BACKGROUND OF THE INVENTION

A color photographic material generally contains a color coupler in at least one of the photographic layers. By color developing the color photographic material, the color coupler reacts with an oxidized aromatic primary amine color developing agent to form a dye such as indophenol, indoaniline, indamine, azomethine, phenoxazine, phenazine. The dye formed by this reaction forms an image.

In the development of color photographic materials a bleach step, fix step and wash step are usually performed after the color development step. Recently, the bleach step and fix step have generally been performed in one bath called a "blix step or bath".

After image-exposure, the color photographic material is subjected to the coloring development process as described above. The development process forms dye images corresponding to the image-exposure. Dyes should not be formed at the areas that have not been color developed.

However, in the color development step and/or the bleach step of the development process for color photographic materials, the areas which are not color developed are colored to a certain extent by color stains.

Hereinafter, the color stain occurring in areas which were not color developed in the development step for a color photographic material will be referred to as "processing stain".

Processing stain occurs at the non-image areas of a color photographic material, i.e., the areas of the color photographic material which should be primarily colorless or white. Accordingly, these processing stains greatly reduce the quality of dye images formed.

The processing stain is particularly likely to occur in a bleach step. The discovery of a color photographic material which can prevent the occurrence of processing stain has been sought by those skilled in the art.

In addition to processing stain, it is known that dye image formed imagewise by such processings after go through various changes with the passage of time. For example, yellow colored images tend to increase in image density with the passing of time. This disrupts the color balance with other colors (magenta and cyan), thereby greatly deteriorating the quality of the dye images (hereinafter, this tendency will be referred to as "color increase with the passage of time").

The discovery of color photographic materials which produce color images causing no color increase with the passage of time has also been sought by those skilled in the art.

SUMMARY OF THE INVENTION

An object of this invention is, therefore, to provide color photographic materials which prevents the occurrence of processing stain.

Another object of this invention is to provide color photographic materials which produce color images where the color increase with the passage of time is prevented.

These objects can be attained by incorporating a compound having the recurring unit represented by the formula (I) in at least one of the photographic layers constituting a color photographic material

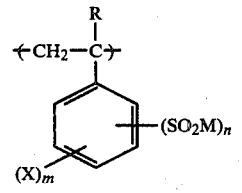

wherein R represents hydrogen, an alkyl group having 1 to 6 carbon atoms such as a methyl group, an ethyl group, etc., or a halogen group such as chlorine, bromine, etc.; M represents hydrogen, an alkali metal such as sodium, potassium, etc., an alkaline earth metal such as calcium, magnesium, etc., or an organic base such as triethylamine, trimethylamine, etc.; m is 0, 1 or 2; and n is 1 or 2.

DESCRIPTION OF THE PREFERRED EMBODIMENTS

The polymers having the recurring unit shown by the formula (I) used in this invention include: (1) a homopolymer obtained by polymerizing the monomer shown by formula (II); (2) a copolymer obtaining by copolymerizing the monomer shown by the formula (II) with another monomer having at least one addition polymerizable unsaturated bond; (3) a polymer obtained by introducing a sulfinic acid group to the side chain thereof after polymerization or copolymerization; and (4) derivatives of these polymers or copolymers.

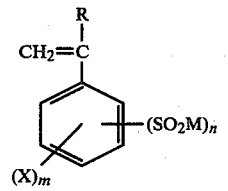

(II)

wherein R, M, X, m and n have the same meaning as defined in the formula (I).

Practical examples of the monomer shown by the formula (II) are as follows:

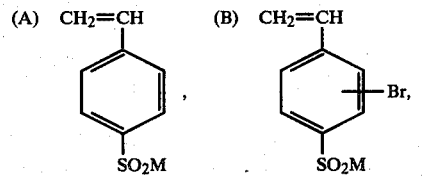

-continued (C) $CH_2{=}C{-}CH_3$ (D) $CH_2{=}CCl$

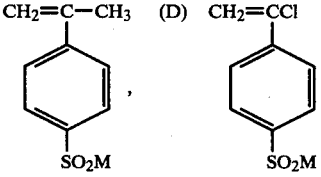

Among these compounds, monomer (A) is a particularly preferred monomer. Monomer (A) can be prepared according to the method described in "Chemical Letters", 419–420 (1976) although other methods may, as a matter of course, be employed. Other monomers may be prepared by the method shown in the above-described Chemistry Letters by using a corresponding sulfonic acid chloride, reducing the product with sodium sulfite and, if desired, vinylating the reduction product.

Furthermore, a polymer having a recurring unit of the formula (I) may be prepared by the aforesaid method using a polymer reaction of a polymer such as polystyrene, etc., as a starting material.

Any monomer can be copolymerized with the monomer shown by the formula (II), if the monomer has at least one addition polymerizable unsaturated bond. Examples of such an addition polymerizable unsaturated compound are include: allyl esters (e.g., allyl acetate, etc.), vinyl ethers (e.g., methyl vinyl ether, methoxy vinyl ether, chloroethyl vinyl ether, diethylene glycol vinyl ether, vinyl 2,4-dichlorophenyl ether, vinyl phenyl ether, etc.), vinyl esters (e.g., vinyl acetate, vinyl dichloroacetate, vinyl dimethyl propionate, vinyl acetoacetate, vinyl salycilate, vinyl benzoate, etc.), vinyl heterocyclic compounds (e.g., N-vinyloxazolidone, N-vinylimidazole, etc.), styrenes (e.g., styrene, methylstyrene, butylstyrene, benzylstyrene, chloromethylstyrene, acetoxymethylstyrene, methoxystyrene, chlorostyrene, dichlorostyrene, fluorostyrene, etc.), olefins (e.g., ethylene, propylene, 1-decene, 5-methyl-1-nonene, etc.), and the like.

The compound used in this invention must contain at least 0.01 mole percent, preferably at least 0.1 mole percent, more preferably at least 1 mole percent of the recurring unit shown by the formula (I).

It is preferred that the molecular weight of the compound having the recurring unit shown by the formula (I) used in this invention is 1,000 to 2,000,000, more preferably 10,000 to 500,000.

The compound of this invention is preferably incorporated in the silver halide emulsion layers, interlayers, or surface protective layers of a color photographic material. However, it is more preferably incorporated in the silver halide emulsion layers. Furthermore, it is particularly preferred to incorporate the compound in silver halide emulsion layers containing color couplers.

It is preferred that the amount of the compound of this invention be 0.05 to 20 g, more preferably 0.1 to 10 g per square meter at the coverage thereof. In particular, when the compound is incorporated in, for example, a yellow coupler-containing silver halide emulsion layer, the amount of the compound is preferably 5 to 100 g, more preferably 10 to 50 g per mole of the yellow coupler.

Preferred examples of the compound used in this invention are shown below, in which the composition ratios are all shown by mole ratio.

(1)

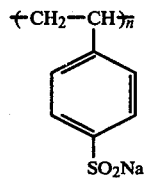

(2)

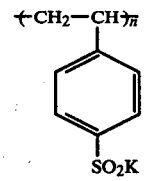

(3)

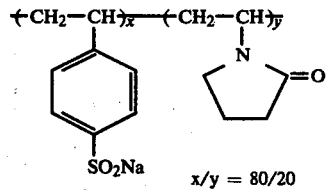

x/y = 80/20

(4)

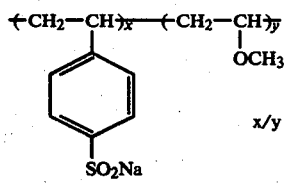

x/y = 50/50

(5)

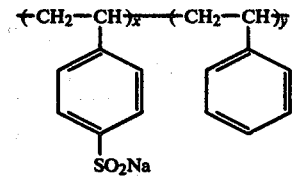

x/y = 70/30

(6)

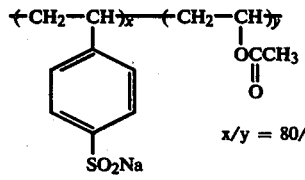

x/y = 80/20

(7)

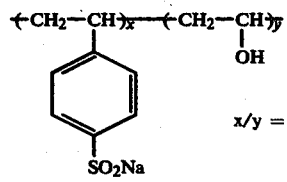

x/y = 80/20

(8)

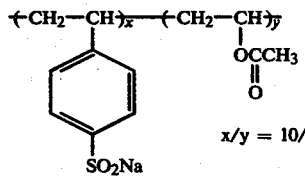

x/y = 10/90

-continued

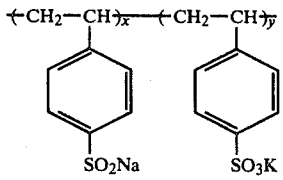

(9)

x/y = 75/25

Among the preferred examples of the compound used in this invention described above, Compounds (1) and (2) are more preferred.

Methods of producing the compounds of this invention are described in detail in the specification of Japanese Patent Application (OPI) No. 4141/81 (the term "OPI" as used herein refers to a "published unexamined Japanese patent application") wherein the compounds of this invention are used for hardening gelatins.

There is no particular restriction on the type of color couplers which can be used in the color photographic materials of this invention. However, when yellow couplers having a pK value of lower than 8.0 are used, greatly improved results are obtained.

A yellow coupler having a pK value of lower than 8.0 readily forms a processing stain in spite of its good coloring property. The occurrence of this processing stain can be prevented by using the compound of this invention.

Methods of measuring the pK value of color couplers are well known, and are described in, for example, I. M. Kolthoft and N. H. Furwan, Potentiometeric Titrations, 3rd edition, published in 1949 by John Wiley and Sons, Inc.; I. M. Kolthoft and H. A. Laitinen, pH and Electro-Titrations, 2nd edition, published in 1948; A. Albert and E. P. Serjeant, Ionization Constants of Acids and Bases, published in 1962 by Methuen and Co., Ltd., and Japanese Patent Application (OPI) No. 13041/75, pages 12–15.

The relation between the pK value of color couplers and the chemical structures is not always simple. Accordingly, it is difficult to specify general formulae of color couplers having a pK value of lower than 8.0.

The yellow couplers preferably used in this invention are shown by the formula (III) which includes yellow coupler having a pK value of lower than 8.0.

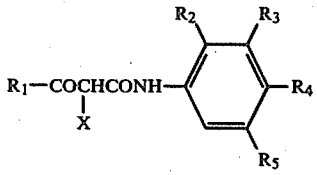

(III)

wherein $R_1$ represents an aryl group which may be substituted by an aryl group having 1 to 10 carbon atoms, an acylamino group, or an alkoxy group having 1 to 5 carbon atoms; a tertiary alkyl group; or an anilino group. The anilino group may be the anilino group substituted by $R_2$, $R_3$, $R_4$ and $R_5$ which are defined below.

Preferred examples of $R_1$ are shown below:

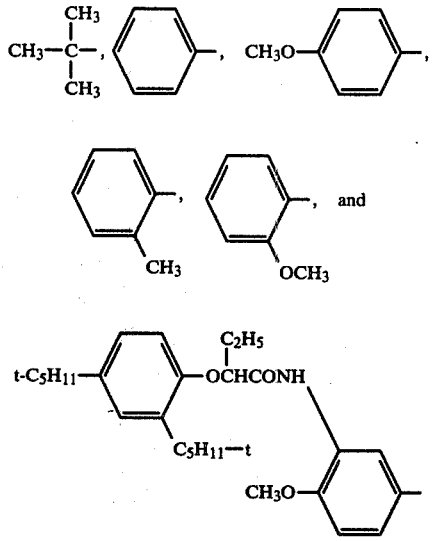

$R_2$ is hydrogen, a halogen group, or an alkoxy group having 1 to 3 carbon atoms. $R_2$ is preferably a chlorine atom or a methoxy group.

$R_3$, $R_4$ and $R_5$ are each independently hydrogen, an alkoxy group having 1 to 2 carbon atoms, an alkoxycarbonyl group having 10 to 20 carbon atoms, an acylamino group, a sulfonamino group, a sulfamoyl group, or a carbamoyl group.

Preferred examples of the anilino group substituted by $R_2$, $R_3$, $R_4$ and $R_5$ are as follows:

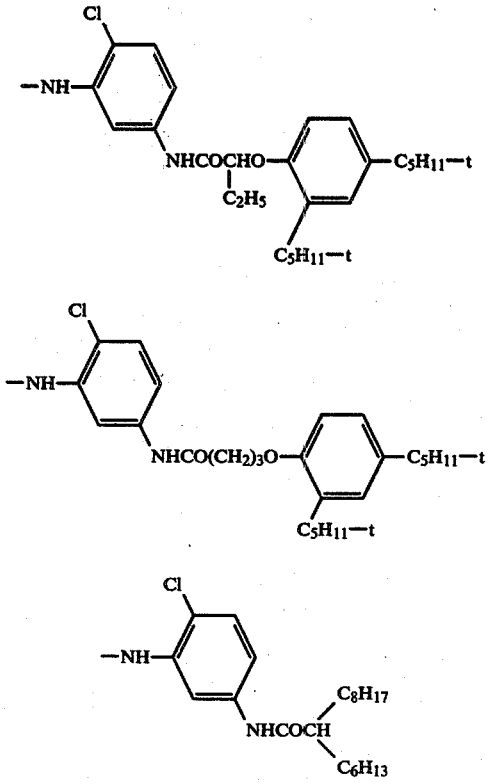

-continued

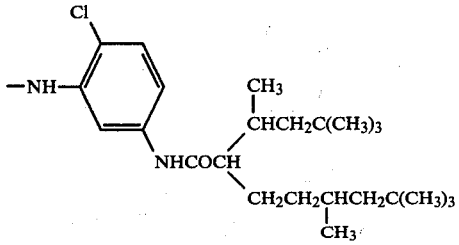

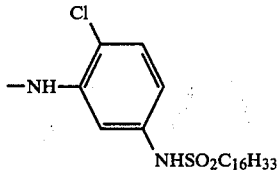

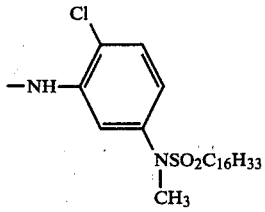

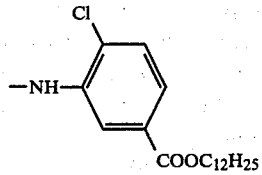

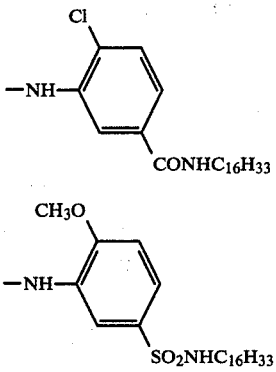

X represents hydrogen,

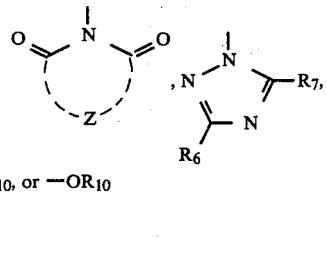

, $-SR_{10}$, or $-OR_{10}$ wherein $R_6$ and $R_7$ represent hydrogen, a halogen group, a carboxylic acid ester group, an amino group, an alkyl group, an alkylthio group, an alkoxy group, an alkylsulfoxy group, a carboxylic acid group, a sulfonic acid group, an unsubstituted or substituted phenyl group, or a heterocyclic group; $R_8$ and $R_9$ represent hydrogen, a halogen group, an alkyl group having 1 to 20 carbon atoms, a phenyl group, a benzyl group, an alkoxy group, an alkoxycarbonyl group, or a carboxy group, $R_{10}$ represents a substituted or unsubstituted aryl group or a heterocyclic group; the substituent being preferably a sulfo group or an acyl group; and Z represents a nonmetallic atomic group necessary for forming a 4-membered, 5-membered or 6-membered ring together with

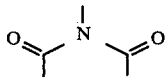

in the formula.

Preferred examples of the heterocyclic ring formed by Z are as follows:

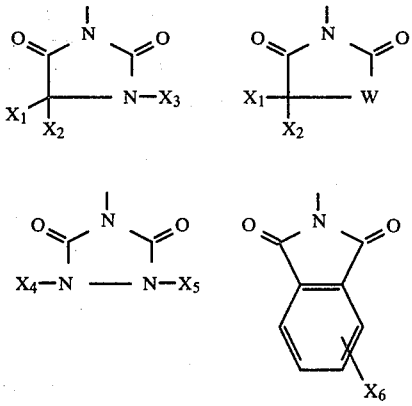

wherein $X_1$ and $X_2$ each represents hydrogen, an alkyl group, an aryl group, an alkoxy group, an aryloxy group or a hydroxy group; $X_3$, $X_4$ and $X_5$ each represents hydrogen, an alkyl group, an aryl group, an aralkyl group, or an acyl group; W represents oxygen or sulfur; $X_6$ represents monovalent groups such as hydrogen, a halogen group, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an imido group, a sulfo group, an alkylsulfonyl group, an arylsulfonyl group, an alkoxysulfonyl group, an aryloxysulfonyl group, a sulfamoyl group, a sulfonamido group, an ureido group, or a thioureido group.

Practical examples of

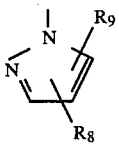

are as follows:

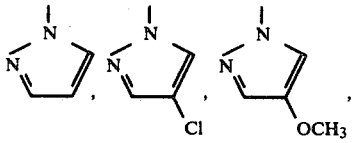
-continued
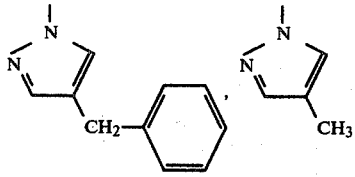
Preferred examples of the yellow couplers represented by the formula (III) which have a pK value below 8.0. are illustrated below:
(III-1)
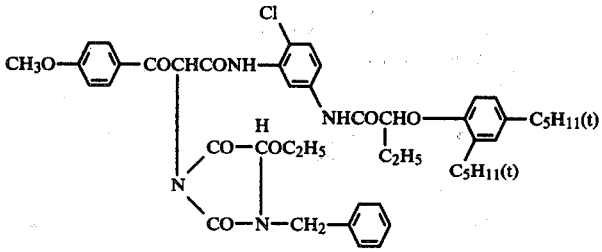
(III-2)
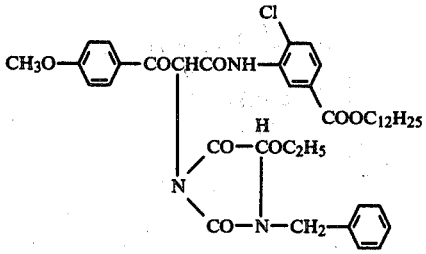
(III-3)
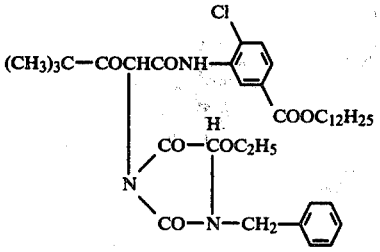
(III-4)
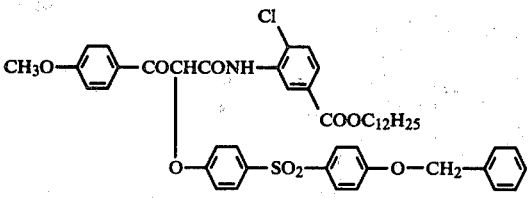
(III-5)
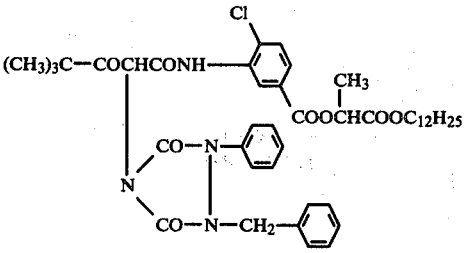

-continued
(III-6)
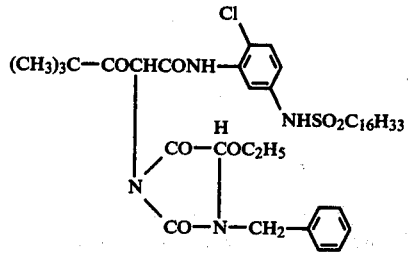
(III-7)
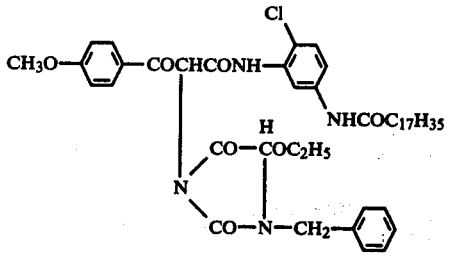
(III-8)
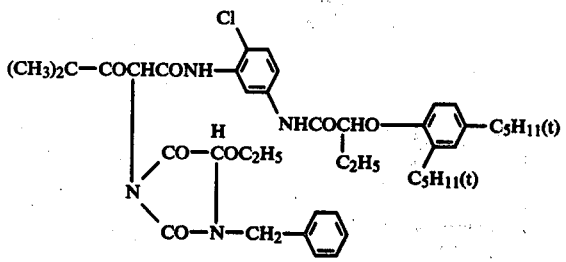
(III-9)
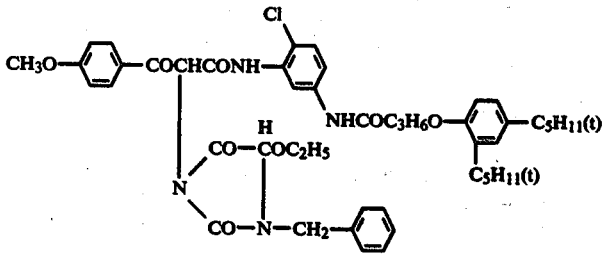
(III-10)
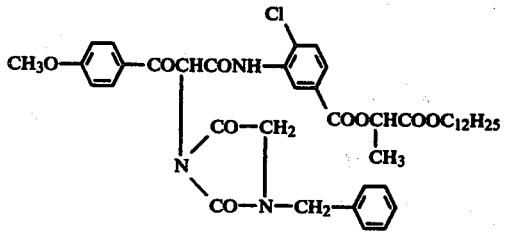
(III-11)
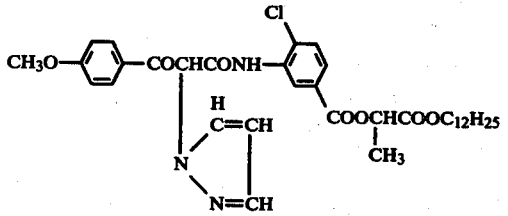

-continued (III-12)

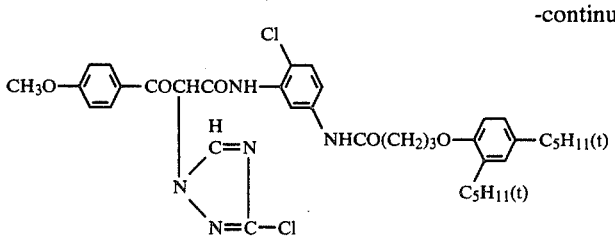

In addition to those described above, other known yellow couplers can be used in connection with this invention. For example, 4-equivalent yellow couplers such as benzoylacetanilides and pivaloylacetanilides can be preferably used.

Known magenta and cyan couplers may be used in connection with this invention.

Magenta couplers used in connection with this invention are described in U.S. Pat. No. 3,615,506 and West German Patent Application (OLS) Nos. 2,418,959 and 2,424,467 and cyan couplers are described in U.S. Pat. Nos. 2,474,293, 3,034,892, 3,591,383, 3,311,476 and 3,476,563. Other color couplers used in connection with this invention are described in *Research Disclosure,* No. 176, 25 (1978).

There is no particular restriction on the amounts of color couplers used but it is preferred that the amount be $2\times10^{-3}$ to $5\times10^{-1}$ mole, and more preferably $1\times10^{-2}$ to $5\times10^{-1}$ mole per mole of silver halide added.

The above-described coupler may be introduced into a silver halide emulsion layer by a known method, for example, the method described in U.S. Pat. No. 2,322,027. The method can be carried out as follows: after dissolving the coupler in a high boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkyl amide (e.g., diethyl laurylamide), a fatty acid ester (e.g., dibutoxyethyl succinate, dioctyl azelate, etc.), a trimesic acid ester (e.g., tributyl trimesate, etc.), or the like, or an organic solvent having a boiling point of from about 30° C. to about 150° C., such as a lower alkyl acetate such as ethyl acetate or butyl acetate, ethyl propionate, a secondary butyl alcohol, methyl isobutyl ketone, $\beta$-ethoxyethyl acetate, methylcellosolve acetate, etc., the solution is dispersed in a hydrophilic colloid. In this case, a mixture of the aforesaid high boiling organic solvent and the low boiling organic solvent may be used.

Furthermore, a dispersion method utilizing polymers which is described in Japanese Patent Publication No. 39853/76 and Japanese Patent Application (OPI) No. 59943/76 can be employed.

When the coupler has an acid group such as carboxylic acid and sulfonic acid, the coupler is added to a hydrophilic colloid as an alkaline aqueous solution of the coupler.

It is also desirable to use other high boiling organic solvents such as those described in U.S. Pat. Nos. 2,322,027, 2,533,514 and 2,835,579; Japanese Patent Publication No. 23233/71; U.S. Pat. No. 3,287,134; British Patent 958,441; Japanese Patent Application (OPI) No. 1031/72; British Patent 1,222,753; U.S. Pat. No. 3,936,303; Japanese Patent Application (OPI) Nos. 26037/76 and 82078/75; U.S. Pat. Nos. 2,353,262, 2,852,383, 3,554,755, 3,676,137, 3,676,142, 3,700,454, 3,748,141, and 3,837,863; West German Patent Application (OLS) No. 2,538,889; Japanese Patent Application (OPI) Nos. 27921/76, 27922/76, 26035/76, 26036/76, and 62632/75; Japanese Patent Publication No. 29461/74; U.S. Pat. Nos. 3,936,303 and 3,748,141; and Japanese Patent Application (OPI) Nos. 1521/78, 31728/79 and 25057/80.

Gelatin may be advantageously used as a binder or a protective colloid for silver halide emulsion layers or other hydrophilic colloid layers. However, other synthetic colloids may be used. For example, proteins such as gelatin derivatives, graft polymers of gelatin and other polymers, albumin, casein; cellulose derivatives such as hydroxyethyl cellulose; carboxymethyl cellulose, cellulose sulfuric acid ester; sugar derivatives such as sodium alginate, starch derivatives; and various synthetic hydrophilic polymers such as the homopolymers of copolymers of polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole; can be used in connection with this invention.

Other useful gelatins include lime-processed gelatin, acid-processed gelatin as well as the hydrolyzed product or enzyme-decomposition product of gelatin. Useful gelatin derivatives can be obtained by reacting gelatin and various compounds such as an acid halide, acid anhydride, isocyanates, bromoacetic acid, alkanesulfones, vinylsulfonamides, maleinimido compounds, polyalkylene oxides, and epoxy compounds.

The color photographic materials of this invention may also contain hydroquinone derivatives, aminophenol derivatives, gallic acid derivatives, ascorbic acid derivatives as color fog preventing agents. Practical examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765; Japanese Patent Application (OPI) Nos. 92988/75, 92989/75, 93928/75, 110337/75 and 146235/77, and Japanese Patent Publication No. 23813/75.

The photographic materials may also contain an ultraviolet absorbent such as benzotriazole compounds substituted by, for example, an aryl group, 4-thiazolidone compounds, benzophenone compounds, cinammic acid ester compounds, butadiene compounds or benzoxazole compounds.

Practical applications of this invention may include antifading agents described below together with the dye image stabilizers of this invention. The dye image stabilizers may be used solely as a combination of two or more. Examples of known antifading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028 and British Patent 1,363,921; the gallic acid derivatives described in U.S. Pat. Nos. 3,457,079 and 3,069,262; the p-alkoxyphenols described in U.S. Pat. Nos. 2,735,765 and 3,698,909, and Japanese Patent Publication Nos. 20977/74 and 6623/77; the p-oxyphenol derivatives described in U.S. Pat. Nos. 3,432,300, 3,573,050, 3,574,627 and 3,764,337, and Japanese Patent Application (OPI) Nos. 35633/77, 147434/77 and 15225/77, and the bisphenols described in U.S. Pat. No. 3,700,455.

There are no particular restrictions on the method of production of the photosensitive silver halide emulsions or other layers of this invention including the chemical sensitizers, antifogging agents, gelatin hardening agents, spectral sensitizing dyes, surface active agents, polymer latexes, lubricants, matting agents, or dyes. Typical useful methods are disclosed within *Research Disclosure,* Vol. 176, pages 22–28 (December 1978).

A color developer is generally composed of an alkaline aqueous solution containing a color developing agent. Useful color developing agents include known primary aromatic amino color developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline and 4-amino-3-methyl-N-ethyl-N-β-methoxyethylaniline).

Other useful color developing agents are described in L.F.A. Mason, Photographic Processing Chemistry, pages 226–229 (published by Pocal Press in 1966); U.S. Pat. Nos. 2,193,015 and 2,592,364; and Japanese Patent Application (OPI) No. 64933/73.

Photographic silver halide emulsion layers are usually bleached after color development. The bleach process may be performed simultaneously with the fix process (blix process) or may be performed separately from a fix process. Useful bleaching agents include compounds of multivalent metals such as iron (III), cobalt (III), chromium (III), copper (II); peracids, quinones, nitroso compounds. Examples of useful bleaching agents include ferricyanides; dichromates; organic complex salts of iron (III) or cobalt (III), such as the complex salts of an aminopolycarboxylic acid as ethylenediamine tetraacetic acid, nitrilotriacetic acid, and 1,3-diamino-2-propanol tetraacetic acid, or an organic acid as citric acid, tartaric acid and malic acid; persulfates; permanganates; and nitrosophenol. Those found to be particularly useful include potassium ferricyanide, sodium iron (III) ethylenediamine tetraacetic acid, and ammonium iron (III) ethylenediamine tetraacetic acid.

Among these bleaching agents, potassium ferricyanide is, in particular, is likely to create processing stains. Accordingly, the invention exhibits particularly remarkable results when used with potassium ferricyanide.

The bleach or blix solution may also contain bleach accelerators such as those described in U.S. Pat. Nos. 3,042,520 and 3,241,966, and Japanese Patent Publication Nos. 8506/70 and 8836/70; the thiol compounds described in Japanese Patent Application (OPI) No. 65732/78; and other various additives.

The invention is illustrated below by the following examples.

EXAMPLE 1

Sample (1) (control sample) was prepared by successively forming the following layers on a cellulose triacetate support.

Layer 1: Red sensitive silver halide emulsion layer:

To 100 g of an iodobromide emulsion (containing 0.06 mole of silver halide and 10 g of gelatin) containing 7 mole percent silver iodide was added $1.8\times10^{-5}$ mole of the sensitizing dye (D-1) having the structure shown below. After adding thereto the emulsified dispersion (H) shown in Table 1 so that the proportion of the coupler became $1\times10^{-1}$ mole per mole of the silver halide, the mixture was coated on the support at a silver coverage of 2 g/m$^2$.

(D-1)

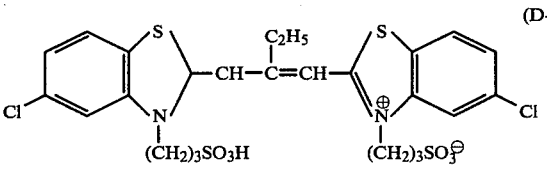

Layer 2: Gelatin interlayer (gelatin coverage of 1 g/m$^2$):

Layer 3: Green sensitive silver halide emulsion layer:

To 100 g of silver iodobromide emulsion (containing 0.06 mole of silver halide and 10 g of gelatin) containing 6 mole percent silver iodide was added the sensitizing dye (D-2) having the structure shown below in an amount of $3\times10^{-5}$ mole. After adding thereto the emulsified dispersion (I) shown in Table 1 so that the proportion of the coupler became $1\times10^{-1}$ mole per mole of silver halide, the mixture was coated at a silver coverage of 2 g/m$^2$.

(D-2)

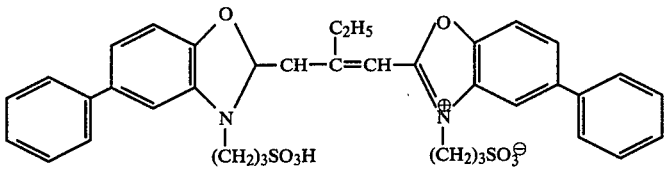

Layer 4: Yellow filter layer (yellow colloid silver coverage of 0.5 g/m$^2$ and gelatin coverage of 0.8 g/m$^2$):

Layer 5: To 100 g of a silver iodobromide emulsion (containing 0.06 mole of silver halide and 10 g of gelatin) containing 6 mole percent silver iodide was added the emulsified dispersion (J) shown in Table 1 so that the proportion of the coupler became $2\times10^{-1}$ mole per mole of silver halide and the mixture was coated at a silver coverage of 1.2 g/m$^2$.

Layer 6: Gelatin protective layer (gelatin coverage of 0.8 g/m$^2$):

TABLE 1

| Composition of Emulsified Dispersion | (H) | (I) | (J) |
|---|---|---|---|
| Aqueous solution of 10 wt. % gelatin | 100 g | 100 g | 100 g |
| Sodium dodecylbenzenesulfonate | 0.5 g | 0.5 g | 0.5 g |
| Tricresyl phosphate | 10 ml | 10 ml | 10 ml |

TABLE 1-continued

| Composition of Emulsified Dispersion | (H) | (I) | (J) |
|---|---|---|---|
| Ethyl acetate | 5 ml | 5 ml | 5 ml |
| Coupler | C - 1<br>10 g | M - 1<br>10 g | Y - 1<br>10 g |

The couplers used are shown below:

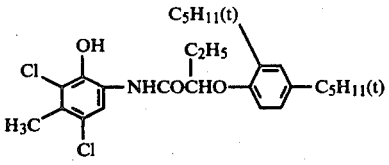

Coupler C-1

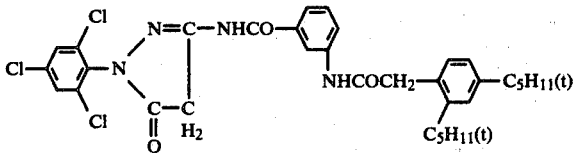

Coupler M-1

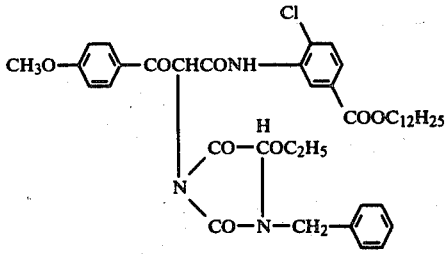

Coupler Y-1

Layers 1 to 6 also contain a hardening agent comprising 2-hydroxy-4,6-dichloro-s-triazine sodium salt which was added in an amount of 1% by weight to the gelatin.

Samples (2), (3), (4), (5), (6) and (7) were prepared in the same manner as Sample (1). However, Compound (2) of this invention was incorporated in Layer 5 in an amount of 1.0, 2.0, 3.0, 5.0, 9.0 and 13.0% by weight respectively based on the weight of the gelatin.

Furthermore, Sample (8) was prepared by incorporating 3.0% by weight of Compound (2) in Layer 6 of the color photographic material having the same construction as Sample (1).

Each sample was image-exposed and processed by the following processing steps.

| Processing step | Temperature | Time |
|---|---|---|
| 1st development | 30° C. | 3 min. |
| Wash | " | 0.5 min. |
| Reversal exposure | (Overall uniform exposure on the emulsion surface for 1 sec. at 8000 lux) | |
| 2nd development | 30° C. | 4 min. |
| Wash | " | 1 min. |
| Bleach | " | 1 min. |
| Wash | " | 0.5 min. |
| Fix | " | 1 min. |
| Wash | " | 1 min. |

The processing solutions used in the above steps had the following compositions.

| | |
|---|---|
| 1st developer: | |
| 4-(N—Methylamino)phenol sulfate | 2 g |
| Sodium sulfate | 90 g |
| Hydroquinone | 8 g |
| Sodium carbonate (mono-hydrate) | 52.5 g |
| Potassium bromide | 5 g |
| Potassium thiocyanate | 1 g |
| Water to make | 1 l |
| 2nd developer: | |
| Benzyl alcohol | 5 ml |
| Sodium sulfite | 5 g |
| Hydroxylamine hydrochloride | 2 g |
| 4-Amino-3-methyl-N—ethyl-N—(β-methanesulfonamidoethyl)aniline sesquisulfate monohydrate | 1.5 g |
| Potassium bromide | 1 g |
| Sodium tertiary phosphate | 30 g |
| Sodium hydroxide | 0.5 g |
| Ethylenediamine (70% aqueous solution) | 7 ml |
| Water to make | 1 l |
| Bleach solution: | |
| Potassium ferricyanide | 100 g |
| Sodium carbonate | 40 g |
| Glacial acetic acid | 20 ml |
| Potassium bromide | 30 g |
| Water to make | 1 l |
| Fix solution: | |
| Sodium thiosulfate | 150 g |
| Sodium acetate | 70 g |
| Sodium sulfite | 10 g |
| Potassium alum | 20 g |
| Water to make | 1 l |

The extent of the occurrence of stains at the colorless areas (non-image areas) was measured on the samples after development. The results are shown in Table 2.

The measurement of stain was performed by means of a Macbeth densitometer using a blue filter "Status A" (TD-504A).

TABLE 2

| Sample No. | Amount of Compound (2) | Stain |
|---|---|---|
| 1* | — | 0.20 |
| 2 | 1.0 | 0.14 |
| 3 | 2.0 | 0.13 |
| 4 | 3.0 | 0.12 |
| 5 | 5.0 | 0.10 |

TABLE 2-continued

| Sample No. | Amount of Compound (2) | Stain |
|---|---|---|
| 6 | 9.0 | 0.08 |
| 7 | 13.0 | 0.07 |
| 8 | 3.0 | 0.13 |

*Control

From the above results, it is understood that by the addition of Compound (2) of this invention, the occurrence of processing stain can be restrained, and particularly, the occurrence of the processing stain in Samples 5 to 7 were restrained.

EXAMPLE 2

A solution obtained by heating 27 g of coupler (Y-2) having the structure shown below, 13.5 ml of dioctylbutyl phosphate as a coupler solvent, and 50 ml of ethyl acetate at 70° C. was added to 300 ml of an aqueous solution containing 50 g of gelatin and 2.0 g of sodium dodecylbenzenesulfonate with stirring. Then the mixture was passed five times through a colloid mill previously heated, thereby the coupler was finely dispersed together with the solvent.

The emulsified dispersion was added to 1.0 kg of a silver halide photographic emulsion containing 60 g of gelatin and 54 g of silver iodobromide. After adding thereto 30 ml of a 5% acetone solution of triethylene phosphamide as a hardening agent, the pH of the mixture was adjusted to 6.0. Then, the mixture was coated on a cellulose triacetate film at a dry thickness of 7.0 microns to provide Sample (11).

Samples (12), (13), (14) and (15) were prepared by adding 1.0, 2.0, 3.0 and 5.0% by weight respectively of Compound (1) of this invention to gelatin in Sample (11).

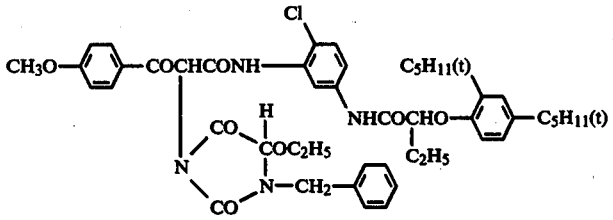

Each sample was image-exposed and subjected to the following processings.

| Processing step | Temperature | Time |
|---|---|---|
| Color development | 36° C. | 3 min. |
| Stop | 25–30° C. | 40 sec. |
| 1st fix | 25–30° C. | 40 sec. |
| Bleach | 25–30° C. | 1 min. |
| 2nd fix | 25–30° C. | 40 sec. |
| Wash | 25–30° C. | 30 sec. |

The processing solutions used in the above processing steps had the following compositions.

| | | |
|---|---|---|
| Color developer: | | |
| Sodium sulfite | | 5.0 g |
| 4-Amino-3-methyl-N,N—diethylaniline | | 3.0 g |
| Sodium carbonate | | 20.0 g |
| Potassium bromide | | 2.0 g |
| Water to make | | 1 l |
| | pH | 10.5 |

-continued

| | | |
|---|---|---|
| Stop solution: | | |
| Sulfuric acid (6N) | | 50.0 ml |
| Water to make | | 1 l |
| | pH | 1.0 |
| Fix solution: | | |
| Ammonium thiosulfate | | 60.0 g |
| Sodium sulfite | | 2.0 g |
| Sodium hydrogensulfite | | 10.0 g |
| Water to make | | 1 l |
| | pH | 5.8 |
| Bleach solution: | | |
| Potassium ferricyanide | | 30.0 g |
| Potassium bromide | | 15.0 g |
| Water to make | | 1 l |
| | pH | 6.5 |

The extent of the occurrence of stains at the colorless areas (non-image areas) was measured on each sample after development. The results are shown in Table 3.

The measurement of stain was performed by means of a Macbeth densitometer using a blue filter "Status A" (TD-504A).

TABLE 3

| Sample No. | Amount of Compound (1) | Stain |
|---|---|---|
| 11* | — | 0.18 |
| 12 | 1.0 | 0.09 |
| 13 | 2.0 | 0.08 |
| 14 | 3.0 | 0.08 |
| 15 | 5.0 | 0.07 |

*Control

From the above results, it is understood that by the addition of Compound (1) of this invention, the occurrence of processing stain can be restrained.

When Samples (11) to (15) were processed in the manner described above, after being preserved for 10 days for 40° C., the coloring density increased considerably in Sample (11) as compared with the sample processed directly after coating. However, the increase of coloring density was not observed in Samples (12) to (15).

Coupler Y-2:

While the invention has been described in detail and with reference to specific embodiment thereof, it will be apparent to one skilld in the art that various changes and modifications can be made therein without departing from the spirit and scope thereof.

What is claimed is:

1. A silver halide color photographic material comprising: a support; and a pluraity of photographic layers including silver halide emulsion layer formed thereon, wherein one of said photographic layers is comprised of a compound containing recurring unit represented by the formula (I) in an amount of at least 0.01 mole percent

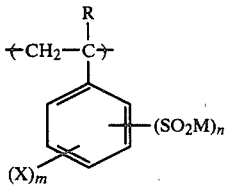

wherein R represents hydrogen, an alkyl group having 1 to 6 carbon atoms, or a halogen group; M represents hydrogen, an alkali metal, an alkaline earth metal, or an organic base; X represents an alkyl group having 1 to 6 carbon atoms, an alkoxy group, an alkylamino group or a halogen group; m represents 0, 1, or 2 and n represents 1 or 2.

2. A silver halide color photographic material as claimed in claim 1 wherein the compound having the recurring unit is incorporated in one of the silver halide emulsion layers of the color photographic material.

3. The silver halide color photographic material as claimed in claim 2 wherein the compound is incorporated in a silver halide emulsion layer further comprising a yellow coupler.

4. The silver halide color photographic material as claimed in claim 1, 2 or 3 wherein the compound is incorporated in a silver halide emulsion layer further comprising a yellow coupler of the formula (III):

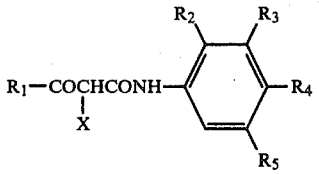

(III)

wherein $R_1$ represents an aryl group which may be substituted by an aryl group having 1–10 carbon atoms, an acylamino group, or an alkoxy group having 1–5 carbon atoms; a tertiary alkyl group; an anilino which may be substituted by $R_2$, $R_3$, $R_4$ and $R_5$;

wherein $R_2$ is hydrogen, a halogen group, or an alkoxy group having 1–3 carbon atoms;

and wherein $R_3$, $R_4$ and $R_5$ are each independently hydrogen, an alkoxy group having 1–2 carbon atoms, an alkoxycarbonyl group having 10–20 carbon atoms, and acylamino group, a sulfonamino group, a sulfamoyl group, or a carbamoly group;

wherein X represents hydrogen,

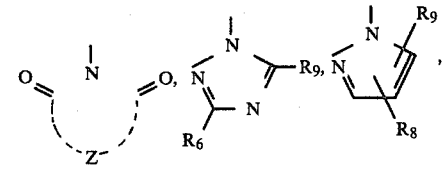

$-SR_{10}$, or $-OR_{10}$ wherein $R_6$ and R represents hydrogen, a halogen group, a carboxylic acid ester group, an amino group, an alkyl group, an alkylthio group, an alkoxy group, an alkylsulfoxy group, a carboxlic acid group, a sulfonic acid group, an unsubstituted or substituted phenyl group, or a heterocyclic group;

wherein $R_8$ and $R_9$ represent hydrogen, a halogen group, a alkyl group having 1–20 carbon atoms, a phenyl group, a benzyl group, an alkoxy group, an alkoxycarbonyl group, or a carboxy group;

wherein $R_{10}$ represents a substituted or unsubstituted aryl group or a heterocyclic group;

and wherein Z represents a non-metallic atomic group necessary for forming a 4-membered, 5-membered or 6-membered ring together with

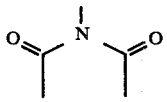

of X;

and having a pK value of lower than 8.0.

5. The silver halide color photographic material as claimed in claim 1 wherein the compound contains at least 1 mole percent of the recurring unit.

6. The silver halide color photographic material as claimed in claim 1 wherein the compound having the recurring unit has a molecular weight of 1,000 to 2,000,000.

7. The silver halide color photographic material as claimed in claim 1 wherein the compound having the recurring unit has a molecular weight of 10,000 to 500,000.

8. The silver halide color photographic material as claimed in claim 1 where in the amount of the compound having the recurring unit incorporated in the photographic layer is 0.05 to 20 g per square meter of the color photographic material.

9. The silver halide color photographic material as claimed in claim 3 wherein the amount of the compound having the recurring unit is 5 to 100 g per mole of the yellow coupler.

* * * * *